US010226092B1

(12) United States Patent
Parker

(10) Patent No.: US 10,226,092 B1
(45) Date of Patent: Mar. 12, 2019

(54) UTILITY CLIP

(71) Applicant: James R. Parker, Franklin, TN (US)

(72) Inventor: James R. Parker, Franklin, TN (US)

( * ) Notice: Subject to any disclaimer, the term of this patent is extended or adjusted under 35 U.S.C. 154(b) by 49 days.

(21) Appl. No.: 15/440,026

(22) Filed: Feb. 23, 2017

(51) Int. Cl.
*A41F 1/00* (2006.01)
*A45F 5/02* (2006.01)
*A44B 99/00* (2010.01)

(52) U.S. Cl.
CPC ..... *A41F 1/00* (2013.01); *A44B 99/00* (2013.01); *A45F 5/02* (2013.01)

(58) Field of Classification Search
CPC ... G09F 3/207; G09F 3/20; A41F 1/00; Y10T 24/1391; Y10T 24/44444; Y10T 24/44564; Y10T 24/44863; Y10T 24/44906; Y10T 24/44932; Y10T 24/44991; A45F 5/02; A44B 99/00
USPC ..... 40/1.6, 1.5, 647
See application file for complete search history.

(56) References Cited

U.S. PATENT DOCUMENTS 5,183,191 A * 2/1993 Garrison ..... A47G 25/485 223/91
6,263,703 B1 * 7/2001 Kenney ..... A44C 7/004 24/507
8,061,569 B2 * 11/2011 Sugita ..... A47G 25/485 223/91
9,521,835 B1 * 12/2016 Gersch ..... A01K 97/10
2015/0335084 A1 * 11/2015 Ditnes ..... A41F 17/02 24/507

* cited by examiner

*Primary Examiner* — Robert Sandy
(74) *Attorney, Agent, or Firm* — Patterson Intellectual Property Law, P.C.; Edward D. Lanquist, Jr.; Alex H. Huffstutter

(57) ABSTRACT

A utility clip may secure an item to clothing. The utility clip may include first and second members. A hinge may pivotably connect the members. A clothing protection member may be disposed between the first member and the second member. The clothing protection member may be configured to protect the clothing from the item disposed between the second member and the clothing protection member. At least one of the first member and the second member may pivot about the hinge such that the utility clip may move from an unactuated position to an actuated position.

21 Claims, 12 Drawing Sheets

UTILITY CLIP

BACKGROUND

The present disclosure relates generally to a clip. More particularly, the present disclosure pertains to a utility clip for securing one or more items to clothing.

Many styles of clips are known in the art. These clips, however, are typically for closing opened bags of snack foods, holding papers together, and the like. Known clips can often be used for multiple purposes, but are also unfit for many specialized applications.

What is needed, therefore, is a utility clip that may secure one or more items to clothing, such as a hunting jacket, to allow the user to conveniently carry the items without occupying his hands.

BRIEF SUMMARY

Briefly, the present disclosure relates, in one embodiment, to a utility clip for securing an item to clothing. The utility clip may include a first member. The first member may include a first article engagement end and a first user engagement end opposite the first article engagement end. The utility clip may also include a second member. The second member may include a second article engagement end and a second user engagement end opposite the second article engagement end. The utility clip may further include a hinge pivotably connecting the first member and the second member. The hinge may be disposed nearer the first and second user engagement ends than the first and second article engagement ends. The utility clip may further still include a clothing protection member disposed between the first member and the second member. The clothing protection member may be configured to protect the clothing from the item disposed between the second member and the clothing protection member. At least one of the first member and the second member may pivot about the hinge such that the utility clip may move from an unactuated position to an actuated position. The first article engagement end and the second article engagement end may be farther apart in the actuated position than the unactuated position. The first user engagement end and the second user engagement end may be farther apart in the unactuated position than the actuated position. The first member and the second member may be biased toward the unactuated position.

In any embodiment, the clothing protection member may include rubber.

In any embodiment, the clothing protection member may be pivotably connected to the hinge.

In any embodiment, the clothing protection member may pivot about the hinge in a total absolute range of about 20 degrees.

In any embodiment, the total absolute range may be about 10 degrees.

In any embodiment, the first member further may include a first inner surface and a first outer surface opposite the first inner surface. The first inner surface may be nearer the second member than the first outer surface. The first inner surface may include a grip surface to grip the clothing.

In any embodiment, the grip surface may include rubber.

In any embodiment, the grip surface may include cloth. The cloth may include a pile.

In any embodiment, the first member may include at least one channel defined in the first outer surface.

The present disclosure also relates, in one embodiment, to a utility clip for securing an item to clothing. The utility clip may include a first member. The first member may include a first article engagement end. A first user engagement end may be opposite the first article engagement end. A first planar section may extend from the first article engagement end to the first user engagement end. The utility clip may also include a second member. The second member may include a second article engagement end. A second user engagement end may be opposite the second article engagement end. A curved section may be disposed between the second article engagement end and the second user engagement end. An angled section may be disposed at the second article engagement end and may extend toward the second user engagement end. A second planar section may extend from the curved section to the angled section. The first member and the second member may be pivotably connected such that the utility clip may move from an unactuated position to an actuated position. The first and second article engagement ends may be farther from each other in the actuated position than in the unactuated position. The first and second user engagement ends may be farther from each other in the unactuated position than in the actuated position. The first planar section and the curved section of the second member may be configured to have a space therebetween in the unactuated position. The first planar section and the angled section of the second member may be configured to have a space therebetween in the unactuated position. The first planar section and the second planar section may be configured to touch in the unactuated position. The first member and the second member may be biased toward the unactuated position.

In any embodiment, the second member may include a second inner surface and a second outer surface opposite the second inner surface. The second inner surface may be nearer the first member than the second outer surface. At least one item retainer passage may be disposed on the second outer surface of the second planar section to retain the item.

In any embodiment, the at least one item retainer passage may include a rectangular passage defined by a raised rectangular portion of the second member.

In any embodiment, the at least one item retainer passage may include one or more elastic straps connected to the second planar section.

In any embodiment, at least one magnet may be disposed on the second planar section of the second member.

In any embodiment, a light source may be disposed on at least one of the first member and the second member.

In any embodiment, the first member may include a first accessory side. The light source may be disposed on the first accessory side of the first member.

In any embodiment, a retractable line may be disposed on the first accessory side of the first member.

The present disclosure also relates, in an embodiment, to a utility clip for securing an item to clothing. The utility clip may include a first member. The first member may include a first article engagement end. A first user engagement end may be opposite the first article engagement end. The utility clip may also include a second member. The second member may include a second article engagement end. A second user engagement end may be opposite the second article engagement end. The second member may further include a second inner surface and a second outer surface opposite the second inner surface. The second inner surface may be nearer the first member than the second outer surface. The second member may also include at least one pair of opposing rails disposed on the second outer surface. A hinge may pivotably connect the first member and the second member. The hinge may be disposed nearer the first and second user engagement ends than the first and second article engagement ends. A first insert may be removably disposed on the outer surface of the second member and secured by the at least one pair of opposing rails. At least one of the first member and the second member may pivot about the hinge such that the utility clip may move from an unactuated position to an actuated position. The first article engagement end and the second article engagement end may be farther apart in the actuated position than the unactuated position. The first user engagement end and the second user engagement end may be farther apart in the unactuated position than the actuated position. The first member and the second member may be biased toward the unactuated position.

In any embodiment, the first insert may include a rectangular first insert body and a center circular portion that may be pivotably connected to the rectangular first insert body.

In any embodiment, the utility clip is included in a kit. The kit may include a second insert. The second insert may include a rectangular second insert body. An inner cavity may be defined in the rectangular second insert body. The first insert and the second insert may be interchangeable such that the at least one pair of opposing rails may secure either the first insert or the second insert.

DETAILED DESCRIPTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof.

Figure 1:
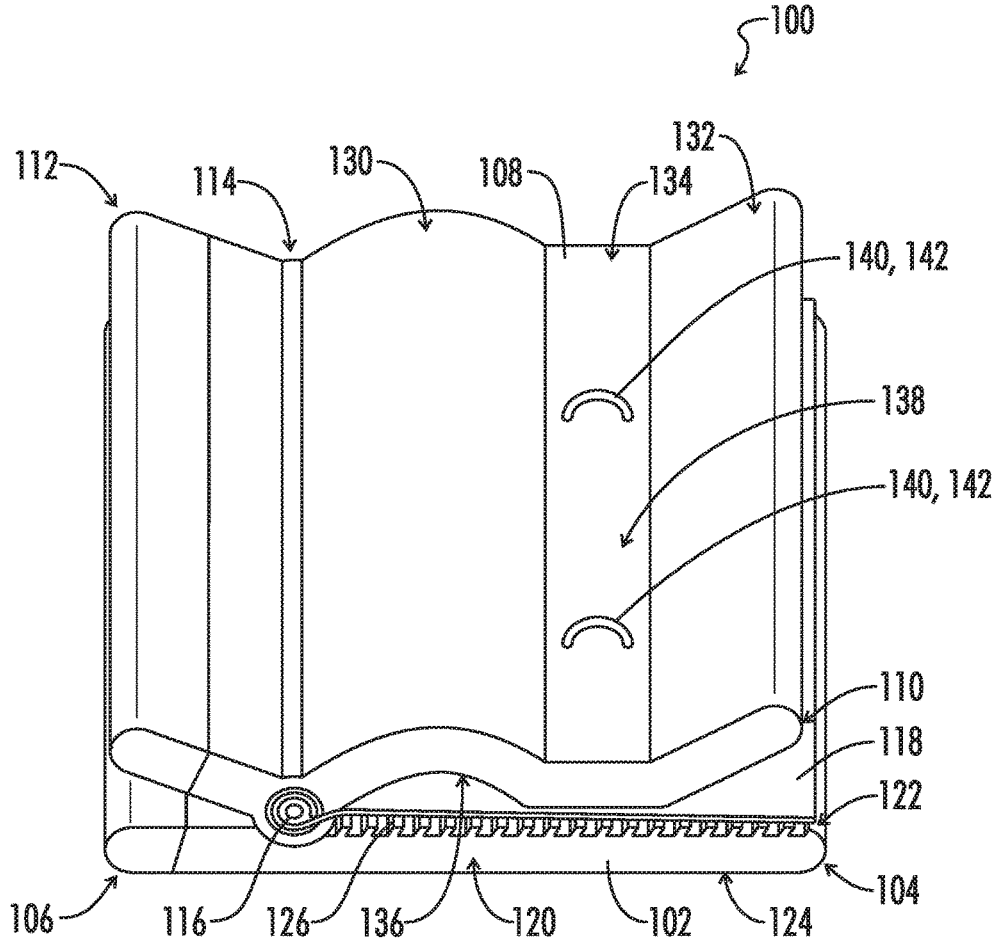
FIG. 1 is a perspective view of one embodiment of a utility clip in the unactuated position.
Figure 2:
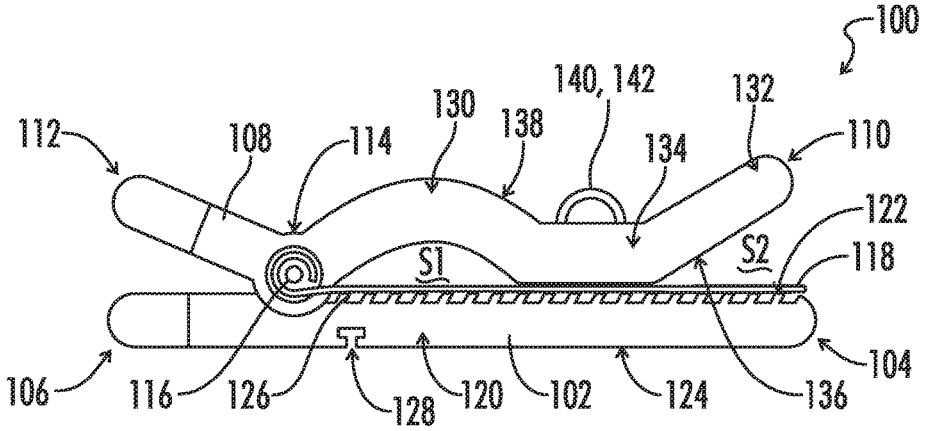
FIG. 2 is a side elevation view of the utility clip of FIG. 1 in the unactuated position.
Figure 3:
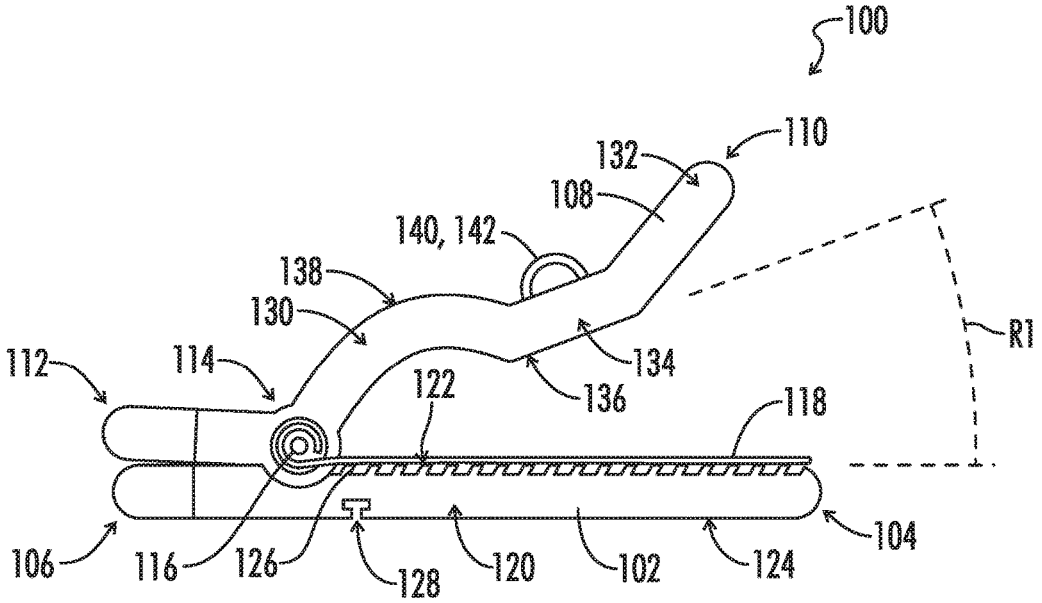
FIG. 3 is a side elevation view of the utility clip of FIG. 1 in the actuated position.

Referring to FIGS. 1-3, a first embodiment of a utility clip 100 is shown. The utility clip 100 may include a first member 102. The first member 102 may include a first article engagement end 104. The first member 102 may further include a first user engagement end 106 opposite the first article engagement end 104.

The utility clip 100 may also include a second member 108. The second member 108 may include a second article engagement end 110. The second member 108 may further include a second user engagement end 112 opposite the second article engagement end 110.

A hinge 114 may pivotably connect the first member 102 and the second member 108. The hinge 114 may be disposed nearer the first and second user engagement ends 106, 112 than the first and second article engagement ends 104, 110. At least one of the first member 102 and the second member 108 may pivot about the hinge 114 such that the utility clip 100 may move from an unactuated position (shown in FIG. 2) to an actuated position (shown in FIG. 3). The first article engagement end 104 and the second article engagement end 110 may be farther apart in the actuated position than in the unactuated position. The first user engagement end 106 and the second user engagement end 112 may be farther apart in the unactuated position than in the actuated position. The first member 102 and the second member 108 may also be biased toward the unactuated position of the utility clip 100. Stated another way, a user may engage the first and second user engagement ends 106, 112 with his hand by pushing the first and second engagement ends together. This force brings the first and second article engagement ends 104, 110 apart against the biasing force of a resilient member 116. The user may release the first and second user engagement ends 106, 112, thereby allowing the resilient member 116 to return the first and second article engagement ends 104, 110 closer together. It should be understood that the resilient member 116 may be any sort of spring or biasing member, any portion of either of the first and second members 102, 108 that are molded or otherwise manufactured to have a bias toward the unactuated position, any sort of hinge that has been molded or otherwise manufactured to bias toward the unactuated position, and the like. The spring could be any spring such as coil springs, leaf springs, and the like. The hinge 114 could be any hinge such as a piano hinge, butt hinge, strap hinge, T-hinge, living hinge, and the like. The hinge 114 may include the spring therein, or the hinge may have biasing properties without a spring.

A clothing protection member 118 may be disposed between the first member 102 and the second member 108. The clothing protection member 118 may be configured to protect the clothing of a user from an item to be held by the utility clip 100 when the item is disposed between the second member 108 and the clothing protection member. If, for instance, a hunter were to place the utility clip 100 on his jacket, he would place the clip on either an unzipped portion of the jacket or on a lapel of the jacket. The jacket would be disposed between the first member 102 and the clothing protection member 118. When the utility clip 100 receives an item, such as a metal flashlight, the item does not come into contact with the jacket. As such, the jacket is less likely to be torn, scratched, or soiled. The clothing protection member 118 may be made of any appropriate material including, but not limited to, cloth, rubber, polymer, leather, and the like. The clothing protection member 118 may also be pivotably connected to the hinge 114 in some embodiments. In such embodiments, the clothing protection member 118 may be pivotable about the hinge 114 in a total absolute range R1 of about 20 degrees. In some embodiments, the total absolute range R1 may be about 10 degrees. The clothing protection member 118 may additionally or alternatively be attached to either the first member 102 or the second member 108.

The first member 102 may also include a first planar section 120. The first planar section 120 may extend from the first article engagement end 104 to the first user engagement end 106 such that the first member 102 is substantially flat, or planar.

The first member 102 may further include a first inner surface 122 and a first outer surface 124 opposite the first inner surface. The first inner surface 122 may be nearer the second member 108 than the first outer surface 124.

The first inner surface 122 may include a grip surface 126 to grip the clothing, such as a portion of a jacket. The grip surface 126 may be disposed on the first inner surface 122 and may be molded as part of the first member 102, affixed to the first member, and the like. The grip surface 126 may be smooth or may include a tread pattern. The grip surface 126 may also be made of rubber, cloth, leather, foam, and the like. In embodiments of the grip surface 126 including cloth, the cloth may include a pile orientation, such as suede, velvet, fur, carpet, and the like.

The first member 102 may also include at least one channel 128 defined in the first outer surface 124. The channel 128 may be sized and shaped to receive a button of a user's jacket to aid in securing the utility clip 100. The channel 128 may be straight, curved, angled, and the like to retain the corresponding button in an appropriate manner.

The second member 108 may also include a curved section 130 disposed between the second article engagement end 110 and the second user engagement end 112. In some embodiments, the curved section 130 may begin adjacent the hinge 114 and may extend toward the second article engagement end 110. Due to the curved section 130 arching away from the first member 102, the first planar section 120 of the first member and the curved section of the second member 108 are configured to have a space S1 therebetween when the utility clip 100 is in the unactuated position (shown in FIG. 2). The curved section 130 may be configured to securely retain certain items the user wishes to carry, such as a flashlight, screw driver, flare, and the like.

The second member 108 may further include an angled section 132. The angled section 132 may, in some embodiments, be disposed at the second article engagement end 110. In such embodiments, the angled section 132 may extend toward the second user engagement end 112. Due to the angled section 132 angling away from the first member 102, the first planar section 120 of the first member and the angled section of the second member 108 are configured to have a space S2 therebetween when the utility clip 100 is in the unactuated position (shown in FIG. 2). The angled section 132 may be configured to allow a user to forcibly insert items to be retained by the utility clip 100 without engaging the first and second user engagement ends 106, 112. This configuration may allow one-handed operation of the utility clip 100.

The second member 108 may also include a second planar section 134. In some embodiments, the second planar section 134 may extend from the curved section 130 to the angled section 132. The first planar section 120 of the first member 102 and the second planar section 134 of the second member 108 may be configured to touch the clothing protection member 118 when the utility clip 100 is in the unactuated position with no clothing or items therebetween (shown in FIG. 2). In some embodiments, however, at least one of the first planar section 120 of the first member 102 and the second planar section 134 of the second member 108 may be configured to have a space between each respective section and the clothing protection member 118 when the utility clip 100 is in the unactuated position. This space could allow for a less forceful hold on items received in the utility clip 100 and may allow room for any appropriate grippers to be attached to the respective planar sections 120, 134 without greatly increasing the gripping force of the utility clip.

The second member 108 may further include a second inner surface 136 and a second outer surface 138 opposite the second inner surface. The second inner surface 136 may be nearer the first member 102 than the second outer surface 138. The second inner surface 136 may have any appropriate configuration similar to, or different from, the first inner surface 122 discussed above.

At least one item retainer passage 140 may be disposed on the second outer surface 138 of the second member 108. In some embodiments, the at least one item retainer passage 140 may be disposed on the second outer surface 138 of the second planar section 134 of the second member 108. In some embodiments, the at least one item retainer passage 140 may include one or more elastic straps 142 connected to the second outer surface 138. In one embodiment, the elastic straps 142 may be connected to the second outer surface 138 of the second planar section 134.

Figure 4:
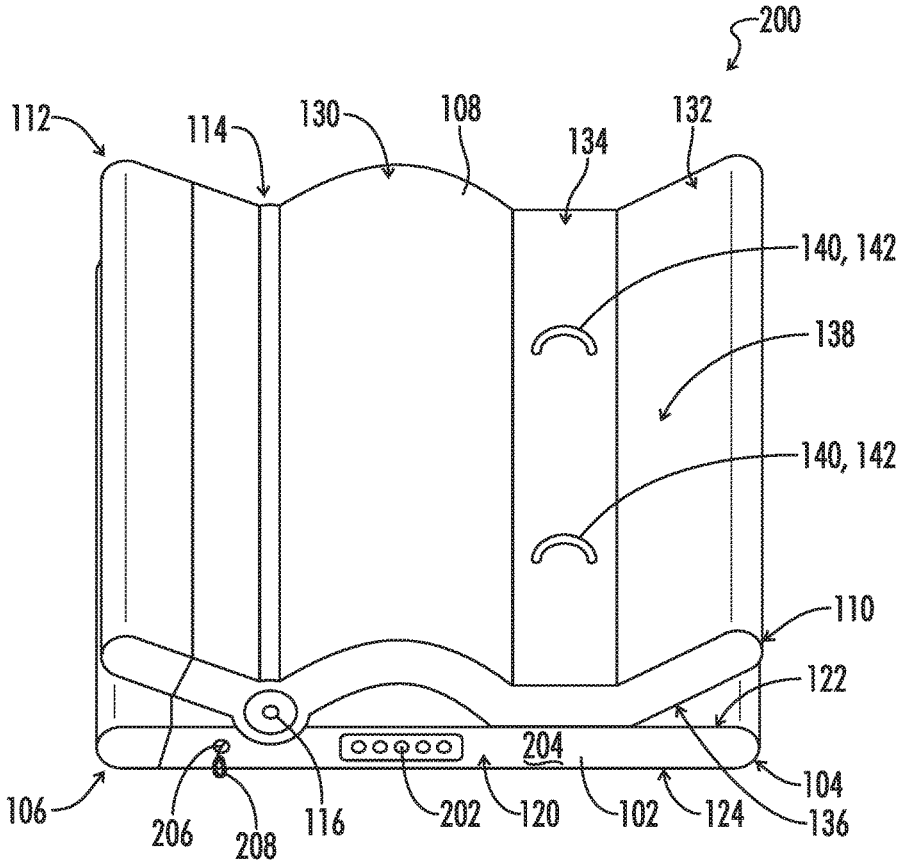
FIG. 4 is a perspective view of another embodiment of a utility clip.
Figure 5:
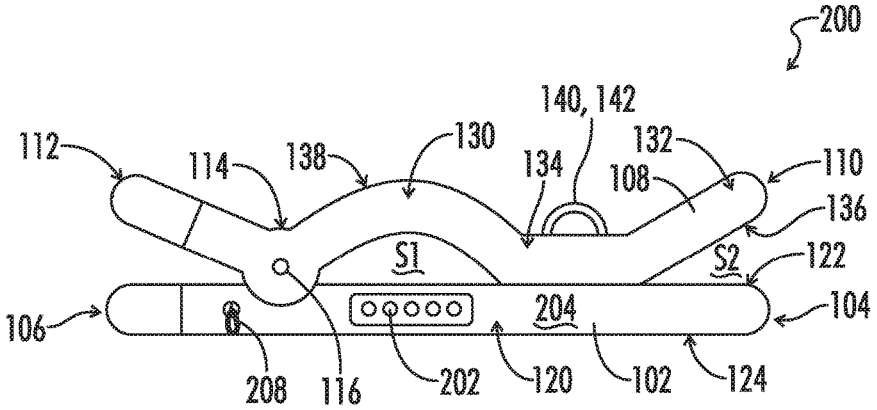
FIG. 5 is a side elevation view of the utility clip of FIG. 4.

Turning now to FIGS. 4 and 5, a second embodiment of a utility clip 200 is shown. The second embodiment of the utility clip 200 may include many components, elements, and features that are similar to those of the first embodiment of the utility clip 100 discussed above. Any substantially similar component, element, or feature with regard to the second embodiment of the utility clip 200 will have the same reference number as that of the corresponding component, element, or feature with regard to the first embodiment of the utility clip 100. As such, not all of the reference characters shown in the drawings may be explicitly mentioned in the specification with regard to the second embodiment of the utility clip 200. Likewise, the description of the second embodiment of the utility clip 200 will be limited to the differences from the first embodiment of the utility clip 100.

The second embodiment of the utility clip 200 may be substantially similar to the first embodiment of the utility clip 100 described above. The second embodiment of the utility clip 200 may be without the clothing protection member 118 of the first embodiment of the utility clip 100, the grip surface 126 of the first embodiment, and the channel 128 of the first embodiment. Other versions of the second embodiment of the utility clip 200 may, however, include the grip surface 126 and the channel 128. When the second embodiment of the utility clip 200 is in the unactuated position (shown in FIG. 5), the first planar section 120 of the first member 102 and the second planar section 134 of the second member 108 may be configured to touch. In some embodiments, however, the first planar section 120 of the first member 102 and the second planar section 134 of the second member 108 may be configured to have a space therebetween when the utility clip 200 is in the unactuated position.

The second embodiment of the utility clip 200 may further include a light source 202 disposed on at least one of the first member 102 and the second member 108. In some embodiments, the light source 202 may be disposed on, or in, the first member 102. In such embodiments, first member 102 may include a first accessory side 204, and the light source 202 may be disposed on the first accessory side of the first member. The light source 202 may be any appropriate light source including, but not limited to, one or more light emitting diodes (LEDs). The utility clip 200 may further include a light switch (not shown) located in any appropriate location on the utility clip.

The second embodiment of the utility clip 200 may also include a retractable line 206 disposed on at least one of the first member 102 and the second member 108. In some embodiments, the retractable line 206 may be disposed on, or in, the first member 102. The retractable line 206 may be coiled within the first member 102, and the coil may be spring-loaded such that the retractable line retracts automatically once released by a user. The end of the retractable line 206 may extend from the first accessory side 204 of the first member 102 when pulled by a user in some embodiments. The retractable line 206 may further include a carabiner 208, hook, loop, or other element attached to the end of the retractable line. In some of such embodiments, the element, shown as a carabiner 208, may hang from the first accessory side 204 of the first member 102.

Figure 6:
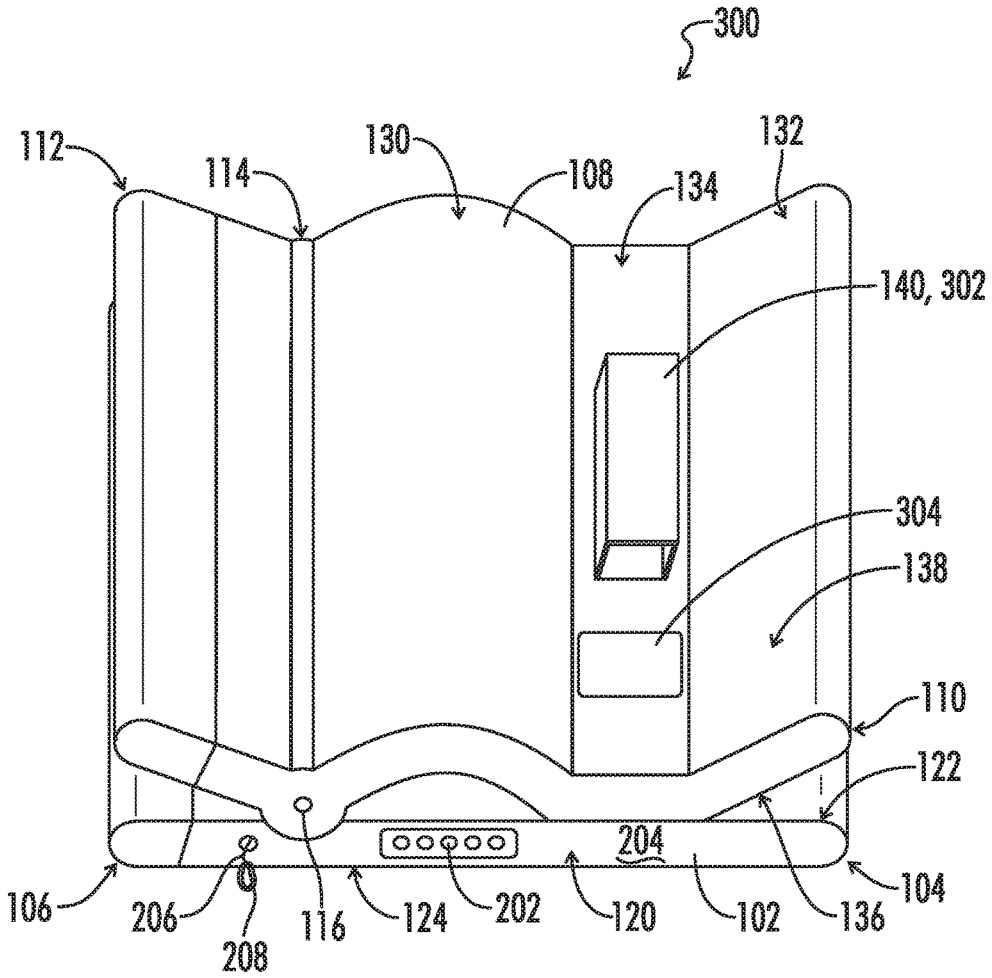
FIG. 6 is a perspective view of yet another embodiment of a utility clip.

Turning now to FIG. 6, a third embodiment of a utility clip 300 is shown. The third embodiment of the utility clip 300 may include many components, elements, and features that are similar to those of the first embodiment of the utility clip 100 and/or the second embodiment of the utility clip 200 discussed above. Any substantially similar component, element, or feature with regard to the third embodiment of the utility clip 300 will have the same reference number as that of the corresponding component, element, or feature with regard to the first embodiment of the utility clip 100 and/or the second embodiment of the utility clip 200. As such, not all of the reference characters shown in the drawings may be explicitly mentioned in the specification with regard to the third embodiment of the utility clip 300. Likewise, the description of the third embodiment of the utility clip 300 will be limited to the differences from the second embodiment of the utility clip 200.

The third embodiment of the utility clip 300 may be substantially similar to the second embodiment of the utility clip 200 described above. The third embodiment of the utility clip 300 may be without the elastic straps 142. Instead, the item retainer passage 140 may include a rectangular passage defined by a raised rectangular portion 302 of the second member 108. In some embodiments, the raised rectangular portion 302 may be disposed on the second outer surface 138 of the second planar section 134. The raised rectangular portion 302 may be sized such that it may receive a variety of items including, but not limited to, pliers, scissors, wire cutters, folding knife attachment clips, surgical tools, and the like. The third embodiment of the utility clip 300 may also include at least one magnet 304 disposed on at least one of the first member 102 and the second member 108. In some embodiments, the magnet 304 may be disposed on the second planar section 134 of the second member 108. The magnet 304 may be overmolded within the second member 108, inserted in a sleeve (not shown) of the second member, inserted in an indentation (not shown) of the second member so the surface of the magnet is flush with the second outer surface 138, and the like.

Figure 7:
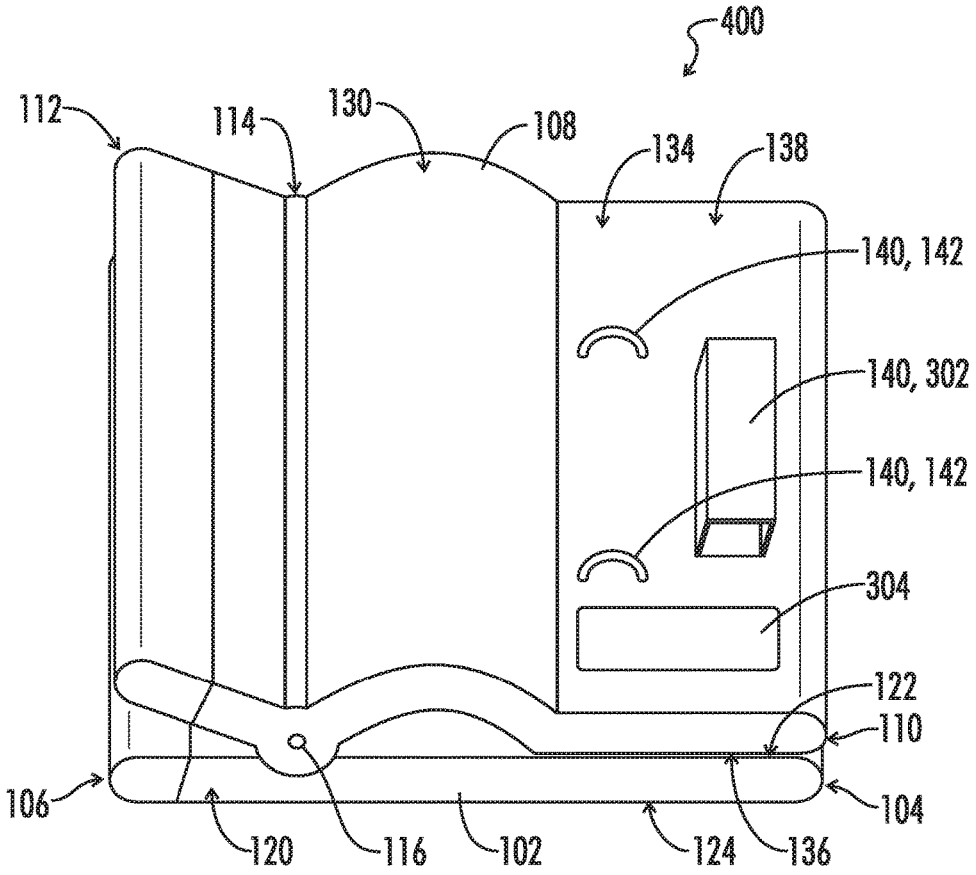
FIG. 7 is a perspective view of still another embodiment of a utility clip.

Turning now to FIG. 7, a fourth embodiment of a utility clip 400 is shown. The fourth embodiment of the utility clip 400 may include many components, elements, and features that are similar to those of the first embodiment of the utility clip 100, the second embodiment of the utility clip 200, and/or the third embodiment of the utility clip 300 discussed above. Any substantially similar component, element, or feature with regard to the fourth embodiment of the utility clip 400 will have the same reference number as that of the corresponding component, element, or feature with regard to the first embodiment of the utility clip 100, the second embodiment of the utility clip 200, and/or the third embodiment of the utility clip 300. As such, not all of the reference characters shown in the drawings may be explicitly mentioned in the specification with regard to the fourth embodiment of the utility clip 400. Likewise, the description of the fourth embodiment of the utility clip 400 will be limited to the differences from the third embodiment of the utility clip 300.

The fourth embodiment of the utility clip 400 may be substantially similar to the third embodiment of the utility clip 300 described above. Although the fourth embodiment of the utility clip 400 is shown without a light source 202, a retractable line 206, and a carabiner 208, the fourth embodiment of the utility clip may include those features in some embodiments. The fourth embodiment of the utility clip 400 may include both the elastic straps 142 and the raised rectangular portion 302, such that the utility clip includes at least two item retainer passages 140. The fourth embodiment of the utility clip 400 may further be without the angled section 132 of the second member 108. Instead, the utility clip 400 may have a longer second planar section 134. In some embodiments, this longer second planar section 134 is what allows for the multiple item retainer passages 140, as well as the longer magnet 304. The longer planar section 134 may also allow for a better grip with more force disbursement on an item disposed between the first member 102 and the second member 108.

Figure 8:
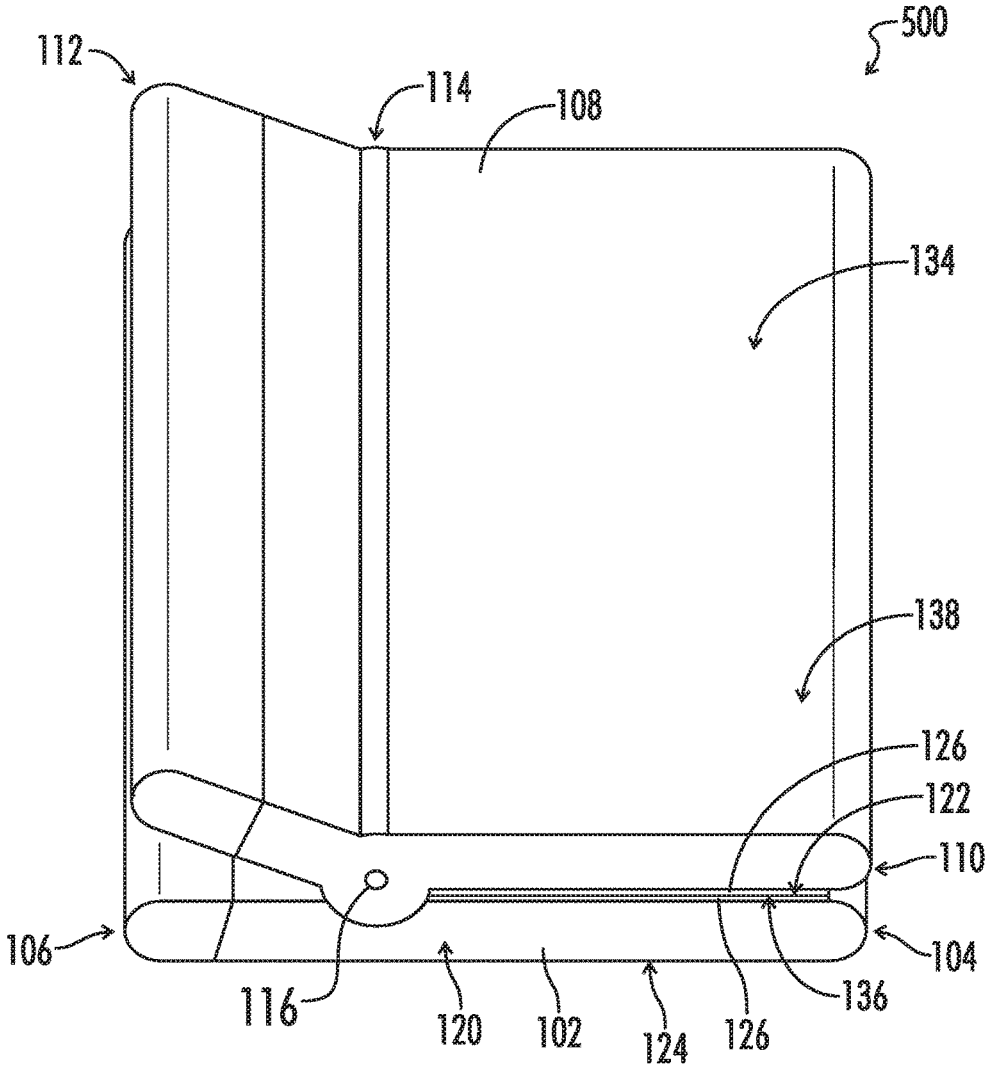
FIG. 8 is a perspective view of a further embodiment of a utility clip.

Turning now to FIG. 8, a fifth embodiment of a utility clip 500 is shown. The fifth embodiment of the utility clip 500 may include many components, elements, and features that are similar to those of the first embodiment of the utility clip 100, the second embodiment of the utility clip 200, the third embodiment of the utility clip 300, and/or the fourth embodiment of the utility clip 400 discussed above. Any substantially similar component, element, or feature with regard to the fifth embodiment of the utility clip 500 will have the same reference number as that of the corresponding component, element, or feature with regard to the first embodiment of the utility clip 100, the second embodiment of the utility clip 200, the third embodiment of the utility clip 300, and/or the fourth embodiment of the utility clip 400. As such, not all of the reference characters shown in the drawings may be explicitly mentioned in the specification with regard to the fifth embodiment of the utility clip 500. Likewise, the description of the fifth embodiment of the utility clip 500 will be limited to the differences from the fourth embodiment of the utility clip 400.

The fifth embodiment of the utility clip 500 may be substantially similar to the fourth embodiment of the utility clip 400 described above. Although the fifth embodiment of the utility clip 500 is shown without a light source 202, a retractable line 206, a carabiner 208, an item retainer passage 140, and a magnet 304, the fifth embodiment of the utility clip may include those features in some embodiments. The fifth embodiment of the utility clip 500 may further be without the curved section 130 of the second member 108. Instead, the utility clip 500 may have a longer still second planar section 134. The longer second planar section 134 allows for space for decorative features or documentation to be shown on the second planar section. A hunting license, for instance, may be held within a clear sleeve (not shown) affixed to the second planar section 134. The longer second planar section 134 may also allow for a better grip with more force disbursement on an item disposed between the first member 102 and the second member 108. The utility clip 500 may further include an offset between the first member 102 and the second member 108 with a grip surface 126 on both the first inner surface 122 and the second inner surface 136. The disbursed forces due to the longer planar section 134, the cushion provided by the two grip surfaces 126, and the lower forces due to the offset first and second members 102, 108 may allow a user to place relatively fragile items between the first member and the second member. In some embodiments, a user may place a cell phone between the first member 102 and the second member 108. Although this embodiment may be particularly suited for fragile items like cell phones, that is not to say any other embodiments discussed herein are not suitable for the same.

Turning now to FIGS. 9-13, a sixth embodiment of a utility clip 600 is shown. The sixth embodiment of the utility clip 600 may include many components, elements, and features that are similar to those of the first embodiment of the utility clip 100, the second embodiment of the utility clip 200, the third embodiment of the utility clip 300, the fourth embodiment of the utility clip 400, and/or the fifth embodiment of the utility clip 500 discussed above. Any substantially similar component, element, or feature with regard to the sixth embodiment of the utility clip 600 will have the same reference number as that of the corresponding component, element, or feature with regard to the first embodiment of the utility clip 100, the second embodiment of the utility clip 200, the third embodiment of the utility clip 300, the fourth embodiment of the utility clip 400, and/or the fifth embodiment of the utility clip 500. As such, not all of the reference characters shown in the drawings may be explicitly mentioned in the specification with regard to the sixth embodiment of the utility clip 600. Likewise, the description of the sixth embodiment of the utility clip 600 will be limited to the differences from the fifth embodiment of the utility clip 500.

The sixth embodiment of the utility clip 600 may be substantially similar to the fifth embodiment of the utility clip 500 described above, but with a few additional features. Although the sixth embodiment of the utility clip 600 is shown without the offset first and second members 102, 108 and the grip surfaces 126, the sixth embodiment of the utility clip may include those features in some embodiments.

Figure 9:
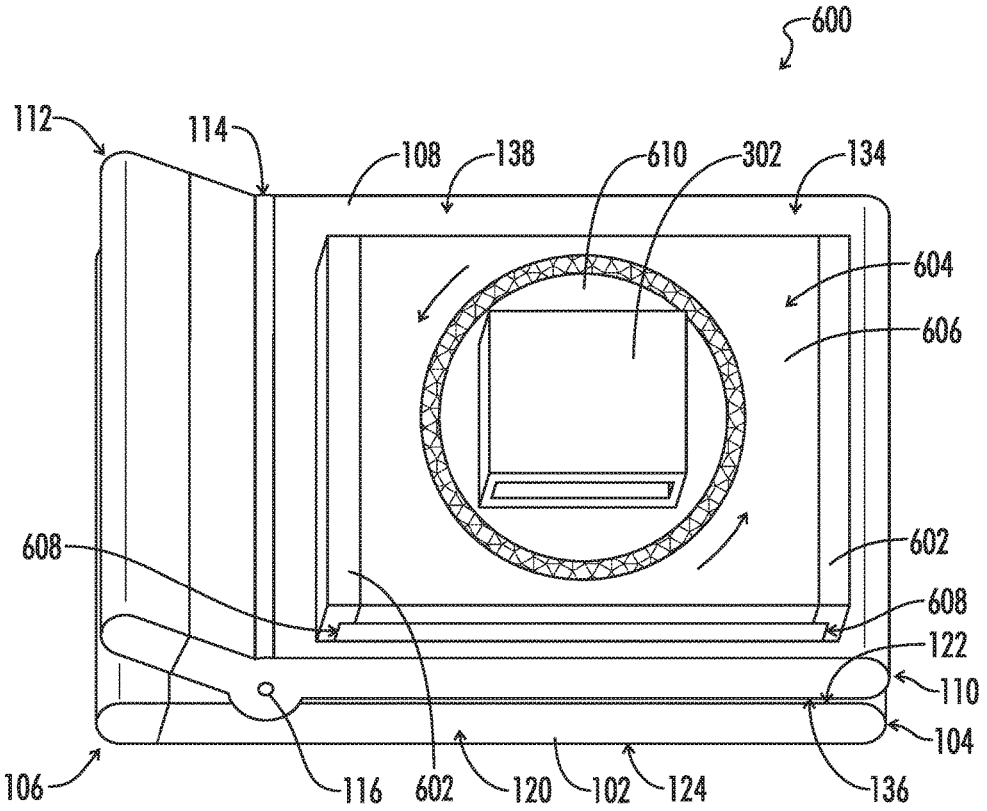
FIG. 9 is a perspective view of an even further embodiment of a utility clip.

The sixth embodiment of the utility clip 600 may further include at least one pair of opposing rails 602 disposed on the second outer surface 138. A first insert 604 may be removably disposed on the second outer surface 138 of the second member 108. The first insert 604 may be secured by the at least one pair of opposing rails 602. In some embodiments, the first insert 604 may be slidably disposed between the at least one pair of opposing rails 602. The first insert 604 may include a rectangular first insert body 606. The rectangular first insert body 606 may include indented rail receiving ends 608 in some embodiments. The first insert 604 may further include a center circular portion 610 pivotably connected to the rectangular first insert body 606. In some embodiments, the center circular portion 610 may be selectively rotationally adjustable relative to the rectangular first insert body 606 with any appropriate mechanism, such as a ratcheting mechanism. This configuration may allow for anything attached to the center circular portion 610 to be rotated to a desired orientation. As shown in FIG. 9, the center circular portion 610 of the first insert 604 may include a raised rectangular portion 302. The raised rectangular portion 302 may be sized similarly to that described above or may alternatively be sized to fit larger items, such as a gun, phone, flashlight, and the like.

Figure 10:
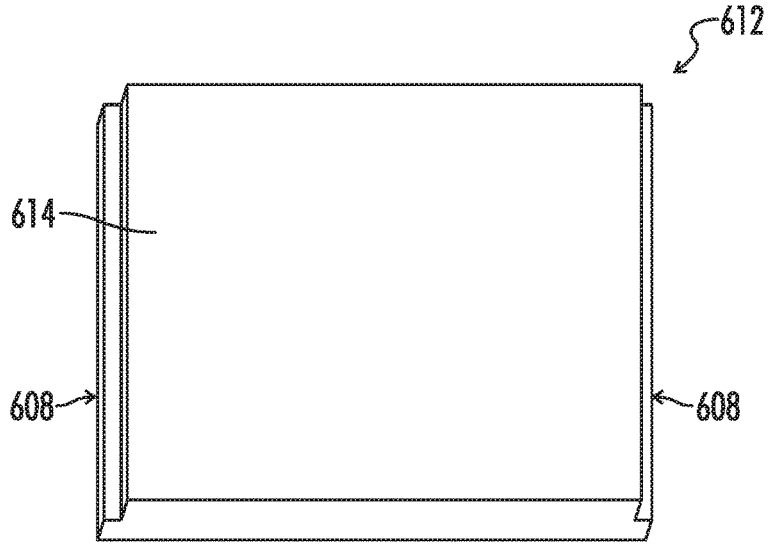
FIG. 10 is a perspective view of a first insert of the utility clip of FIG. 9.
Figure 11:
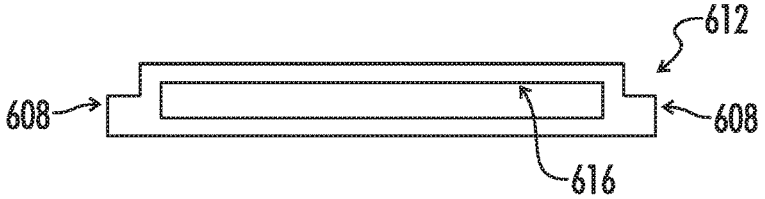
FIG. 11 is a side elevation view of the first insert of FIG. 10.

A second insert 612 is shown in FIGS. 10 and 11. The second insert 612 may include a second insert body 614 that may be rectangular and may have an inner cavity 616 to receive various items, such as documentation, a cell phone, fishing lures, and the like. The inner cavity 616 may, in some embodiments, be lined with the grip surface 126 to aid in securing contents in the inner cavity.

Figure 12:
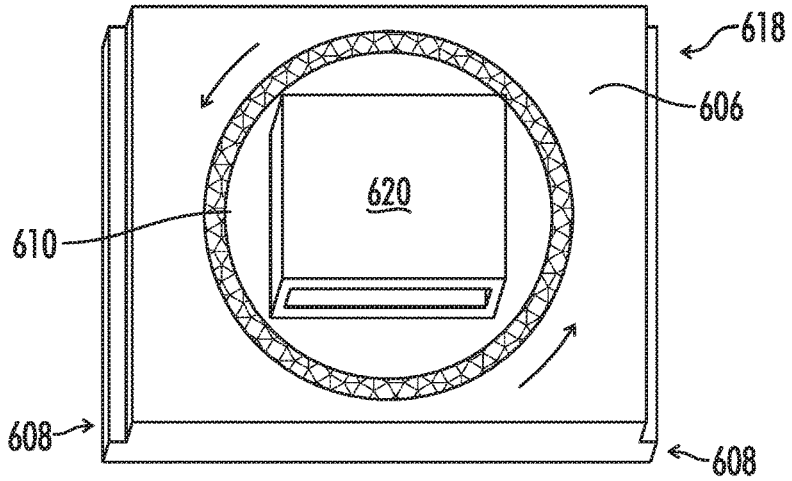
FIG. 12 is a perspective view of a second insert of the utility clip of FIG. 9.

A third insert 618 is shown in FIG. 12. The third insert 618 may be substantially similar to the first insert 604, but it may include a fastener surface 620 for receiving various items. The fastener surface 620 may, for instance, include a section of either hooks or loops with a corresponding section of the opposite affixed to the item to be connected to the third insert 618.

The components shown in FIGS. 9-12 may be included in a kit. The kit may include at least two of the first insert 604, the second insert 612, and the third insert 618 being interchangeable. The at least one pair of opposing rails 602 may receive and secure at least one of the inserts 604, 612, 618 at time.

Figure 13:
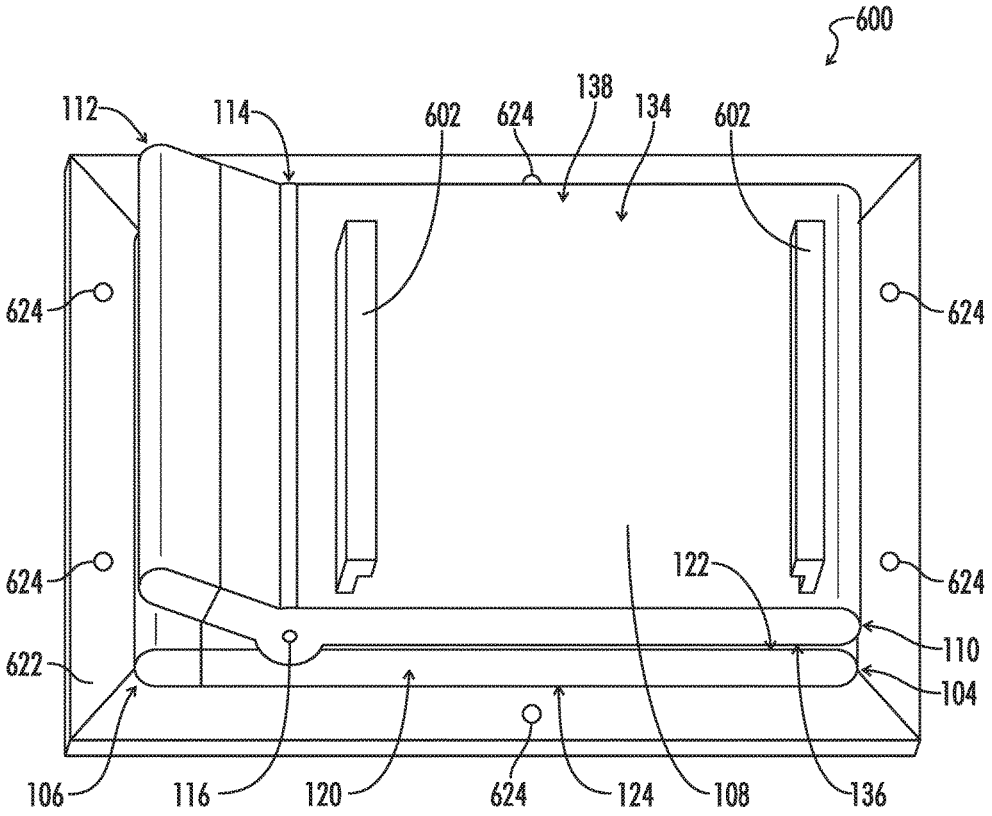
FIG. 13 is a perspective view of the utility clip of FIG. 9 with an optional flange.

As shown in FIG. 13, some embodiments of the utility clip 600 may include at least one flange 622. The at least one flange 622 may be integral with or attached to the first member 102. The at least one flange 622 may be configured to be sewn into a garment or bag, such that the utility clip 600 may be affixed thereto. The at least one flange 622 may further include one or more anchor points 624. The anchor points 624 may include holes or posts to aid in affixing the utility clip 600.

Figure 14:
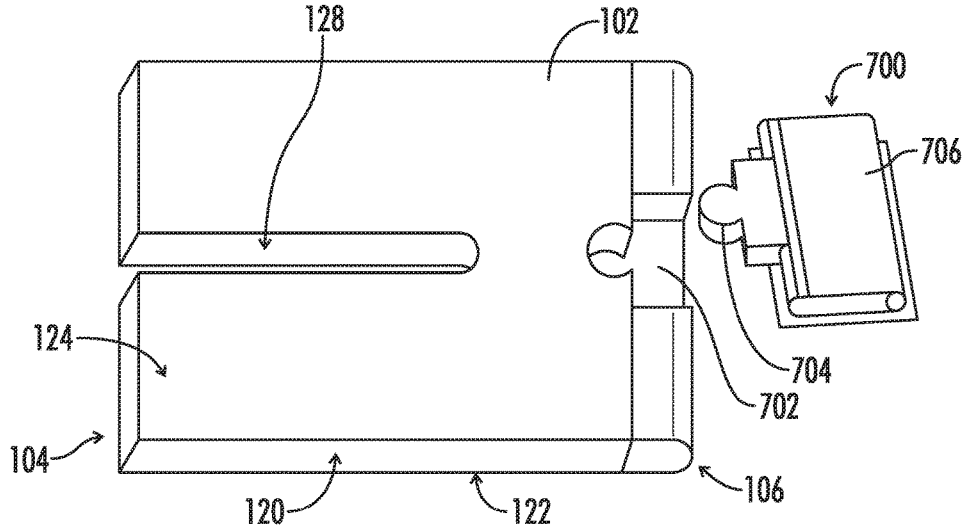
FIG. 14 is a perspective view of an optional embodiment of the first member for any of the above utility clips.

Turning now to FIG. 14, an embodiment of the first member 102 is shown with a corresponding clamp accessory 700. This embodiment of the first member 102 may be associated with any of the previously discussed embodiments of the utility clip. The first member 102 may include a female connector 702 defined in the first outer surface 124. The corresponding clamp accessory 700 may have a compatible male connector 704 to be received in the female connector 702. The clamp accessory 700 may further include a clamp 706 opposite the male connector 704. The clamp 706 may be configured to receive a portion of a user's clothing to aid in securing the utility clip to the clothing. In one embodiment, the channel 128 receives a button of one side of an open jacket, and the clamp 706 clamps onto the other side of the open jacket such that the open sides of the jacket are held together by the utility clip.

Figure 15:
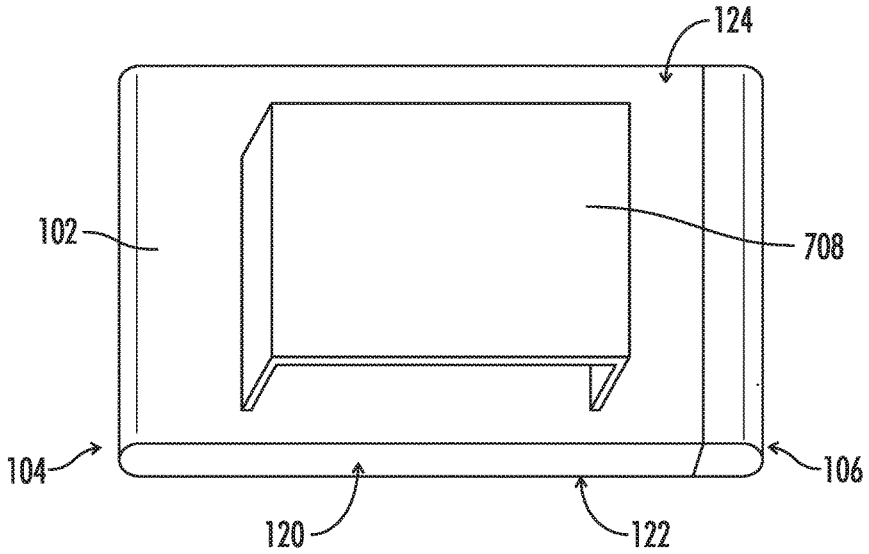
FIG. 15 is a perspective view of another optional embodiment of the first member for any of the above utility clips.

FIG. 15 shows another embodiment of the first member 102 with an optional belt clip or loop 708. The belt clip/loop 708 may be configured to be secured to a user's belt much like a typical phone clip in some embodiments.

Figure 16:
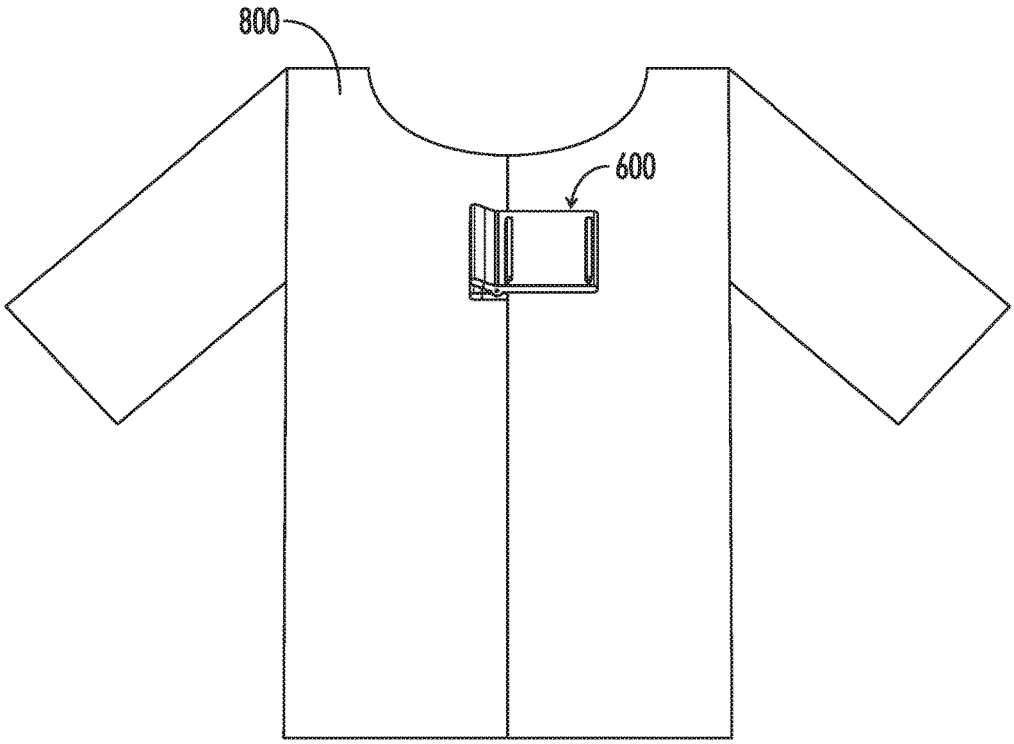
FIG. 16 shows a front elevation view of the utility clip of FIG. 9 clipped onto an article of clothing.
Figure 17:
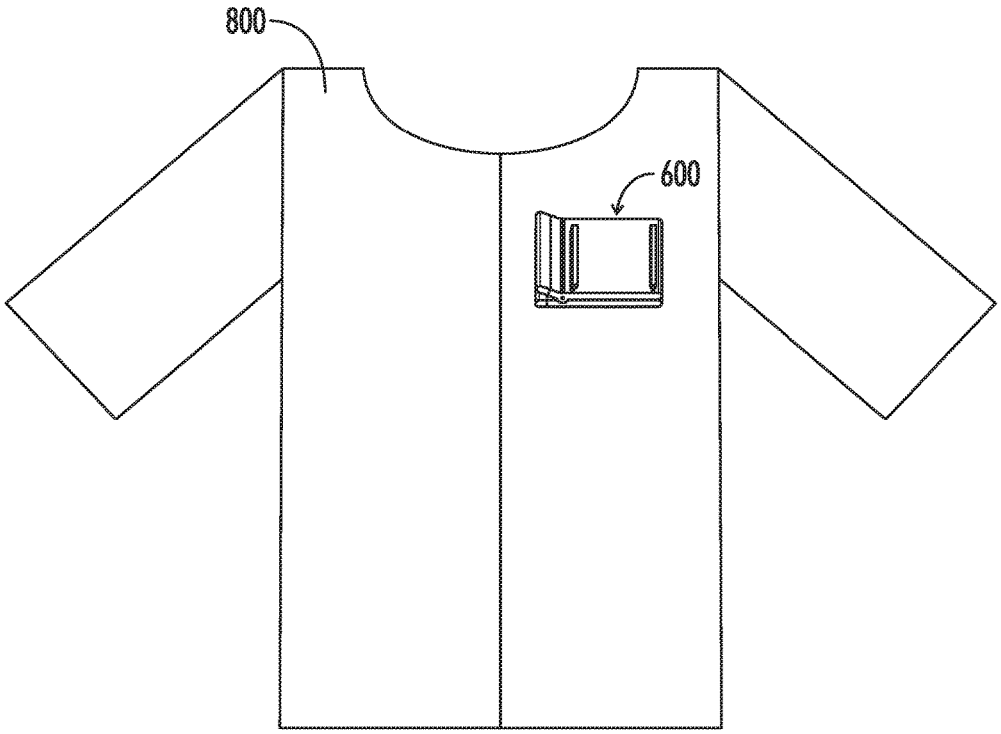
FIG. 17 shows a front elevation view of the utility clip of FIG. 13 permanently affixed to an article of clothing.

As represented in FIG. 16, any of the utility clips discussed herein may be clipped onto a portion of a garment, such as a jacket 800. As shown in FIG. 17, any of the utility clips including at least one flange 622, or some other structure such as adhesives, fasteners, and the like, may be permanently affixed to the garment 800.

This written description uses examples to disclose the invention and also to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Although embodiments of the disclosure have been described using specific terms, such description is for illustrative purposes only. The words used are words of description rather than limitation. It is to be understood that changes and variations may be made by those of ordinary skill in the art without departing from the spirit or the scope of the present disclosure, which is set forth in the following claims. In addition, it should be understood that aspects of the various embodiments may be interchanged in whole or in part. While specific uses for the subject matter of the disclosure have been exemplified, other uses are contemplated. Therefore, the spirit and scope of the appended claims should not be limited to the description of the versions contained herein.

What is claimed is:

1. A utility clip for securing an item to clothing, the utility clip comprising:
- a first member including:
  - a first article engagement end; and
  - a first user engagement end opposite the first article engagement end;
- a second member including:
  - a second article engagement end; and
  - a second user engagement end opposite the second article engagement end;
- a hinge pivotably connecting the first member and the second member, the hinge disposed nearer the first and second user engagement ends than the first and second article engagement ends;
- a clothing protection member disposed between the first member and the second member, the clothing protection member pivotably connected to the hinge, the clothing protection member configured to protect the clothing from the item disposed between the second member and the clothing protection member; and wherein:
- at least one of the first member and the second member may pivot about the hinge such that the utility clip may move from an unactuated position to an actuated position;
- the first article engagement end and the second article engagement end are farther apart in the actuated position than the unactuated position;
- the first user engagement end and the second user engagement end are farther apart in the unactuated position than the actuated position; and
- the first member and the second member are biased toward the unactuated position.

2. The utility clip of claim 1, wherein:
the clothing protection member includes rubber.

3. The utility clip of claim 1, wherein:
the clothing protection member is pivotable about the hinge in a total absolute range of about 20 degrees.

4. The utility clip of claim 3, wherein:
the total absolute range is about 10 degrees.

5. The utility clip of claim 1, wherein:
- the first member further includes a first inner surface and a first outer surface opposite the first inner surface;
- the first inner surface is nearer the second member than the first outer surface; and
- the first inner surface includes a grip surface to grip the clothing.

6. The utility clip of claim 5, wherein:
the grip surface includes rubber.

7. The utility clip of claim 5, wherein:
the grip surface includes cloth; and
the cloth includes a pile.

8. The utility clip of claim 5, wherein:
the first member further includes at least one channel defined in the first outer surface.

9. A utility clip for securing an item to clothing, the utility clip comprising:
- a first member including:
  - a first article engagement end;
  - a first user engagement end opposite the first article engagement end; and
  - a first planar section extending from the first article engagement end to the first user engagement end;
- a second member including:
  - a second article engagement end;
  - a second user engagement end opposite the second article engagement end;
  - a curved section disposed between the second article engagement end and the second user engagement end;
  - an angled section disposed at the second article engagement end and extending toward the second user engagement end; and
  - a second planar section extending from the curved section to the angled section; and wherein:
- the first member and the second member are pivotably connected such that the utility clip may move from an unactuated position to an actuated position;
- the first and second article engagement ends are farther from each other in the actuated position than in the unactuated position;
- the first and second user engagement ends are farther from each other in the unactuated position than in the actuated position;

the first planar section and the curved section of the second member are configured to have a space therebetween in the unactuated position;

the first planar section and the angled section of the second member are configured to have a space therebetween in the unactuated position;

the first planar section and the second planar section are configured to touch in the unactuated position; and the first member and the second member are biased toward the unactuated position.

10. The utility clip of claim 9, wherein:

the second member further includes a second inner surface and a second outer surface opposite the second inner surface, the second inner surface nearer the first member than the second outer surface; and at least one item retainer passage is disposed on the second outer surface of the second planar section to retain the item.

11. The utility clip of claim 10, wherein:

the at least one item retainer passage includes a rectangular passage defined by a raised rectangular portion of the second member.

12. The utility clip of claim 10, wherein:

the at least one item retainer passage includes one or more elastic straps connected to the second planar section.

13. The utility clip of claim 9, further comprising:

at least one magnet disposed on the second planar section of the second member.

14. The utility clip of claim 9, further comprising:

a light source disposed on at least one of the first member and the second member.

15. The utility clip of claim 14, wherein:

the first member includes a first accessory side; and the light source is disposed on the first accessory side of the first member.

16. The utility clip of claim 15, further comprising:

a retractable line disposed on the first accessory side of the first member.

17. A utility clip for securing an item to clothing, the utility clip comprising:

a first member including:

a first article engagement end; and a first user engagement end opposite the first article engagement end;

a second member including:

a second article engagement end;

a second user engagement end opposite the second article engagement end;

a second inner surface and a second outer surface opposite the second inner surface, the second inner surface nearer the first member than the second outer surface; and at least one pair of opposing rails disposed on the second outer surface;

a hinge pivotably connecting the first member and the second member, the hinge disposed nearer the first and second user engagement ends than the first and second article engagement ends;

a first insert removably disposed on the outer surface of the second member and secured by the at least one pair of opposing rails; and wherein:

at least one of the first member and the second member pivots about the hinge such that the utility clip moves from an unactuated position to an actuated position;

the first article engagement end and the second article engagement end are farther apart in the actuated position than the unactuated position;

the first user engagement end and the second user engagement end are farther apart in the unactuated position than the actuated position; and the first member and the second member are biased toward the unactuated position.

18. The utility clip of claim 17, wherein:

the first insert includes a rectangular first insert body and a center circular portion that is pivotably connected to the rectangular first insert body.

19. The utility clip of claim 18, wherein:

the utility clip is included in a kit;

the kit further includes a second insert;

the second insert includes a rectangular second insert body;

an inner cavity is defined in the rectangular second insert body; and the first insert and the second insert are interchangeable such that the at least one pair of opposing rails may secure either the first insert or the second insert.

20. The utility clip of claim 18, further comprising:

a flange connected to the first member, the flange configured to be permanently connected to the clothing.

21. The utility clip of claim 18, further comprising:

an article of clothing; and wherein the first member is permanently connected to the article of clothing.

* * * * *